US005732448A

United States Patent [19]

Shields et al.

[11] Patent Number: 5,732,448

[45] Date of Patent: Mar. 31, 1998

[54] STIRRUP BUCKLE

[76] Inventors: Robert L. Shields, P.O. Box 623, Newburgh, Ind. 47629; Ben G. Veach, 140 Woodhaven Dr., Greencastle, Ind. 46135

[21] Appl. No.: 774,741

[22] Filed: Dec. 31, 1996

[51] Int. Cl.[6] ..... A44B 11/00

[52] U.S. Cl. ..... 24/180; 24/170; 24/191

[58] Field of Search ..... 24/180, 170, 173, 24/174, 163 K, 191, 585

[56] References Cited

U.S. PATENT DOCUMENTS

| | | | |
|---|---|---|---|
| 72,266 | 12/1867 | Clock . | |
| 322,789 | 7/1885 | Chapman . | |
| 405,925 | 6/1889 | Stubbs . | |
| 697,543 | 4/1902 | Rose | 24/180 |
| 740,951 | 10/1903 | Uhlrig . | |
| 855,637 | 5/1907 | Humphrey . | |
| 1,055,045 | 3/1913 | Hunter . | |
| 1,365,551 | 1/1921 | Settles . | |
| 1,487,577 | 3/1924 | Kerngood . | |
| 1,620,157 | 3/1927 | Knistrom | 24/191 |
| 1,654,805 | 1/1928 | Hamric . | |
| 2,253,749 | 12/1941 | Beazley . | |
| 3,209,423 | 10/1965 | Cattin . | |
| 3,570,077 | 3/1971 | Hawie . | |
| 3,608,158 | 9/1971 | Bengtsson . | |
| 3,852,855 | 12/1974 | Bengtsson | 24/170 |
| 4,233,712 | 11/1980 | Horst et al. . | |
| 4,631,784 | 12/1986 | Fildan . | |

FOREIGN PATENT DOCUMENTS

| | | | |
|---|---|---|---|
| 0933270 | 8/1963 | United Kingdom | 24/191 |

OTHER PUBLICATIONS

Advertisement by Blevins Mfg. Co. Inc., Wheatland, Wyoming, in *Western Horseman* Magazine, p. 96, Feb. 1994.

*Primary Examiner*—Victor N. Sakran

*Attorney, Agent, or Firm*—Middleton & Reutlinger; David W. Carrithers

[57] ABSTRACT

A stirrup buckle for releasably connecting a stirrup strap to the saddle strap of a saddle. The buckle is a two piece assembly having a base mounting plate with side flanges and a pivoting angled tongue lever member connected thereto pivotally mounted between the side flanges. The base mounting plate securely attaches the buckle to the stirrup strap. At least one post and preferably, a pair of posts are formed on the underside of the tongue lever member. The posts are spaced apart in a side by side relationship extending inwardly from the rear underside of the tongue lever member for insertion through selected spaced holes of the saddle strap. The posts located on the tongue lever member extend through matching slots formed through the surface of the base plate flush with the exterior surface for securing the two straps together.

6 Claims, 4 Drawing Sheets

STIRRUP BUCKLE

BACKGROUND OF THE INVENTION

1. Technical Field

This invention relates to stirrup buckles and in particular to a buckle which will facilitate and expedite the changing of the stirrup length, and which will provide a safe and secure connection between the stirrup strap and saddle strap.

2. Background Information

One of the elements of a riding saddle used for horses whether it be an English saddle, Australian saddle, Western saddle or other type, is the use of straps for adjustably suspending the stirrups which extend downwardly from the side of the saddle. Each of the stirrups is usually suspended in the looped end of a stirrup strap, which in turn is adjustably connected to a saddle strap, which strap is either rigidly or loosely connected to the saddle and extends downwardly therefrom.

Some type of buckle or fastening means is provided between the saddle strap and stirrup strap to enable an adjustment to be made to the length of the stirrup strap to enable the stirrup to accommodate various size riders. It is desirable that the strap connection or buckle provide an easy means for rapidly changing the stirrup length, while ensuring a rigid and secure connection between the saddle strap and stirrup strap to prevent premature separation of the connection therebetween, which could result in injury to the rider.

The most common type of stirrup buckle used for many Western type saddles is referred to as a "Bierins" buckle, and is shown in U.S. Pat. No. 3,314,121. Although this type of buckle has proven satisfactory over the years, it has one possible shortcoming, that is, as the buckle and straps age and after repeated use, the sliding connection between the sleeve and elongated tongue may become loose and not fit as securely thereon as desirable. This can result in the buckle becoming separated enabling the strap connecting posts to work free of their engagement in the holes of the saddle strap and become disconnected.

Therefore, the need exists for a stirrup buckle which ensures a secure connection between the saddle strap and stirrup strap in an easy and effective manner.

Objectives of the invention include providing an improved stirrup buckle which permits the easy adjustment between the stirrup strap and saddle strap to permit the length of the stirrup to be easily adjusted, yet which rigidly secures the two straps together preventing their premature separation even after extended periods of use of the buckle.

A still further objective of the invention is to provide a stirrup buckle which is formed relatively inexpensively of a light weight inexpensive two piece member, preferably composed of plastic, which is rigidly and permanently secured to the stirrup strap and is adapted to be easily and securely releasably attached to the saddle strap to permit easy adjustment of the stirrup lengths.

Still another objective of the invention is to provide such a stirrup buckle in which the front portion of the tongue is angled outwardly slightly to enable the stirrup strap and saddle strap to lie in general alignment with each other thereby decreasing the bulkiness and unevenness when the straps are connected, thereby reducing the formation of projections which are uncomfortable to the horse and/or rider.

A further objective of the invention is to provide such a stirrup buckle which requires movement of the buckle to tighten the connection between the stirrup and saddle strap, whereby the motion occurring during riding of the horse tightens the buckle, thereby further preventing any accidental and premature separation of the connected buckle during riding which could possibly result in injury to the rider.

Another objective of the invention is to provide such a stirrup buckle which is sturdy and durable in construction, reliable and efficient in operation, relatively simple and inexpensive to manufacture and install on the stirrup strap, and which is easy to manipulate in a relatively expeditious manner to facilitate the changing of stirrup lengths.

Accordingly, the improved stirrup buckle 10 provides an effective, safe, inexpensive, a efficient device which achieves all the enumerated objective provides for eliminating difficulties encountered with prior devices, and solves problems and obtains new results in the art.

SUMMARY OF THE INVENTION

The present invention is a stirrup buckle for releasably connecting a stirrup strap to the saddle strap of a saddle. The buckle is a two piece assembly having a base mounting plate with side flanges and a pivoting tongue lever member connected thereto pivotally mounted between the side flanges. The base mounting plate securely attaches the buckle to the stirrup strap. At least one post and preferably, a pair of posts are formed on the underside of the tongue lever member. The posts are spaced apart in a side by side relationship extending inwardly from the rear underside of the tongue lever member for insertion through selected spaced holes of the saddle strap. The posts located on the tongue lever member extend through matching slots formed through the surface of the base plate flush with the exterior surface for securing the two straps together.

The tongue lever member is designed having an integrally formed thin generally trapezoidal shaped front portion, a thin central portion, and a thicker rear portion including a pair of hinge posts extending outwardly therefrom in the same plane for cooperative engagement with apertures formed in the side flanges of the base mounting plate. The central portion of the tongue lever member is flat. The front portion of the tongue lever member extends upwardly at a slight angle forming a tab and accommodating a string or pull member. The bottom surface of the rear portion of the tongue lever member extends outwardly in the same plane as the central portion. The end of the rear portion is rounded and the rear surface of the posts extend flush with the rounded rear end portion providing a camming surface for tightening the strap between the tongue lever member and the mounting base plate while simultaneously forcing the posts through holes formed in the strap. The top surface of the rear portion extends upwardly to the rear end at an angle of from about 15 to about 60 degrees and preferably at an angle of about 30 degrees forming the thicker rear end portion which forms a cam to hold the saddle strap in position upon insertion between the tongue lever member and mounting base plate.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENTS

Figure 1:
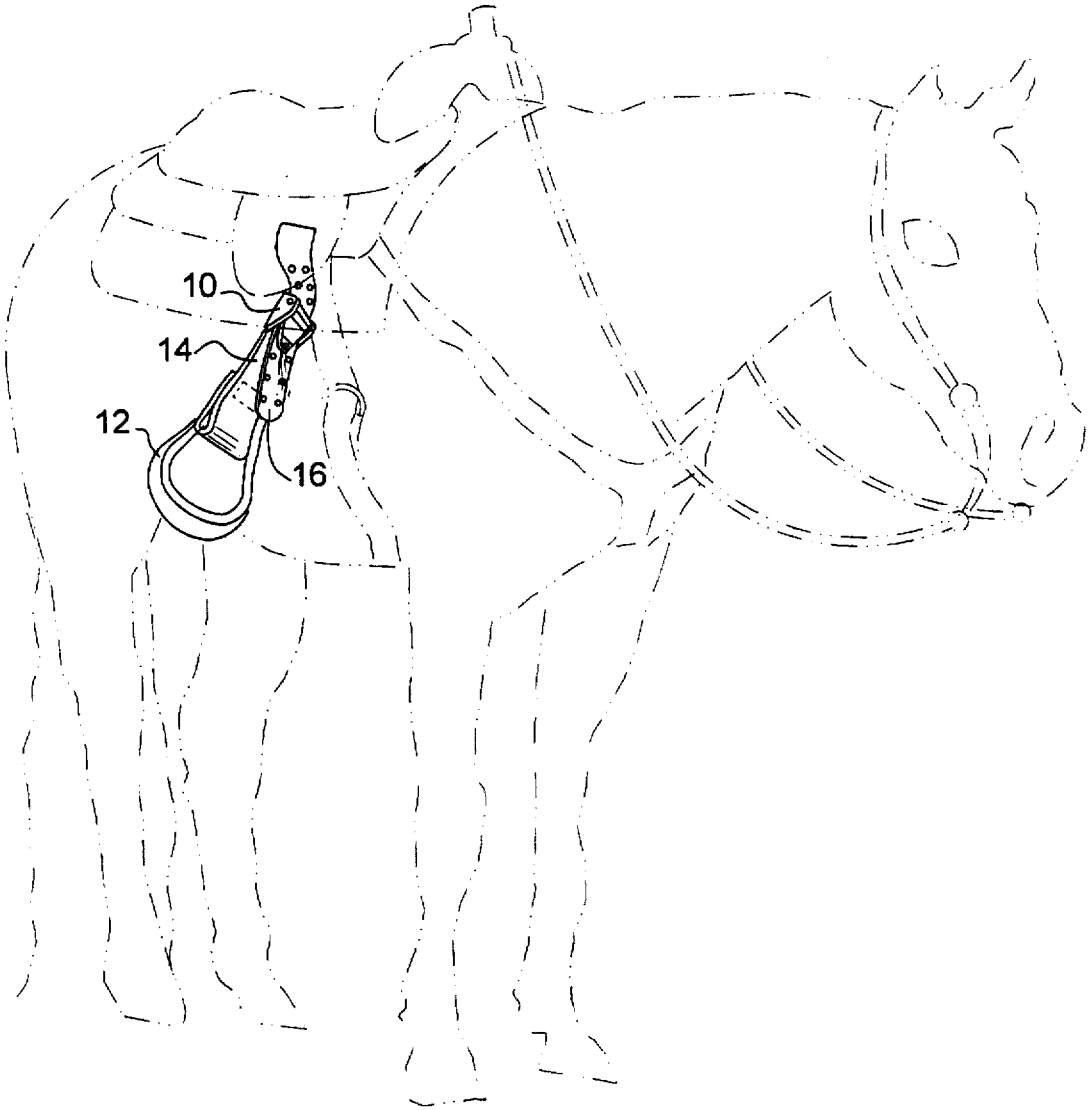
FIG. 1 a perspective view of the present invention showing the stirrup buckle connecting a stirrup strap to a saddle strap and showing a saddle and horse in phantom lines.
Figure 2:
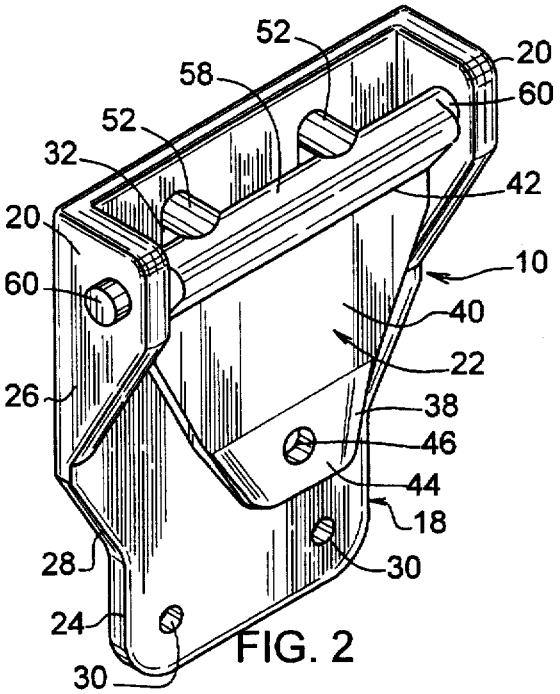
FIG. 2 is a perspective view showing the stirrup buckle mounting base plate and tongue lever member.
Figure 3:
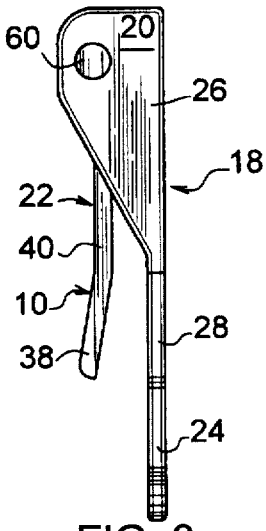
FIG. 3 is a side view showing the stirrup buckle.
Figure 4:
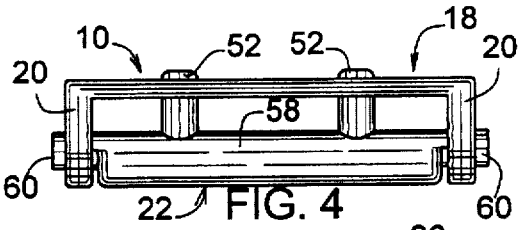
FIG. 4 is a rear view showing the stirrup buckle.
Figure 5:
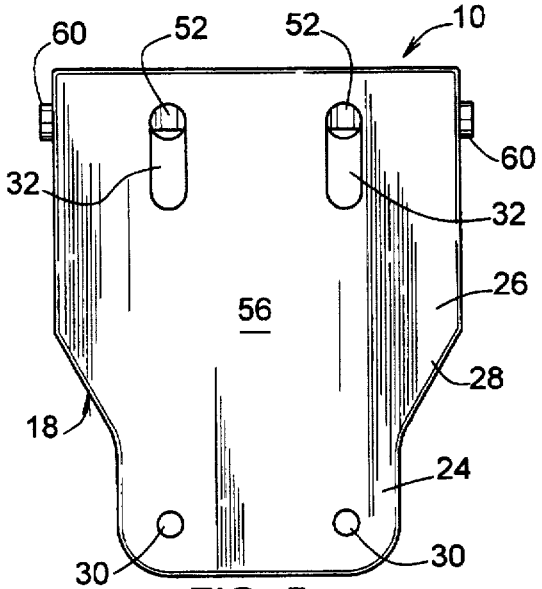
FIG. 5 is a bottom view showing the stirrup buckle.
Figure 6:
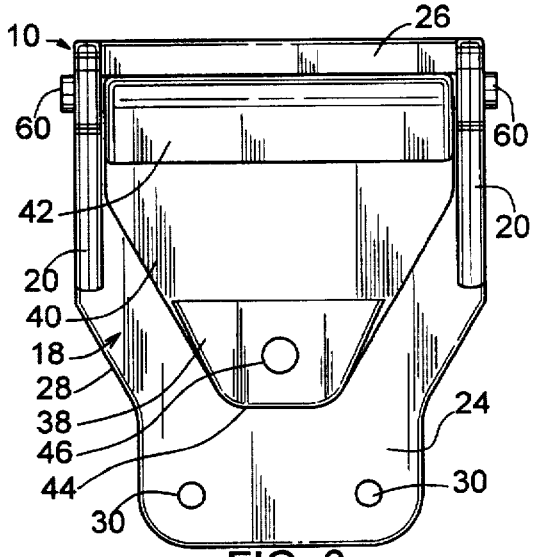
FIG. 6 is a top view showing the stirrup buckle.
Figure 7:
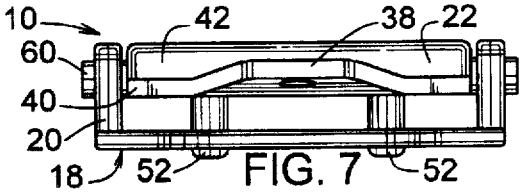
FIG. 7 a front end view showing the stirrup buckle.
Figure 9:
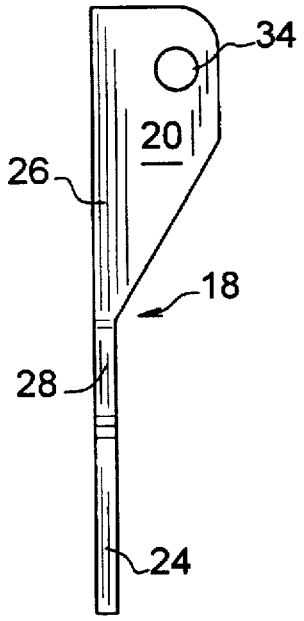
FIG. 9 is a side view showing the mounting base plate of the stirrup buckle of FIG. 8.
Figure 8:
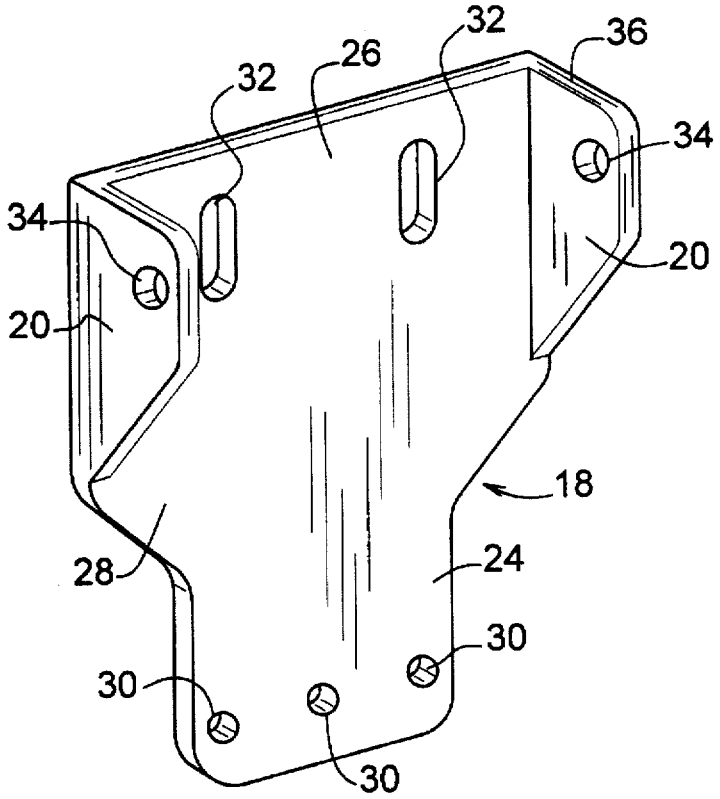
FIG. 8 is a perspective view showing the mounting base plate of the stirrup buckle of the present invention.
Figure 11:
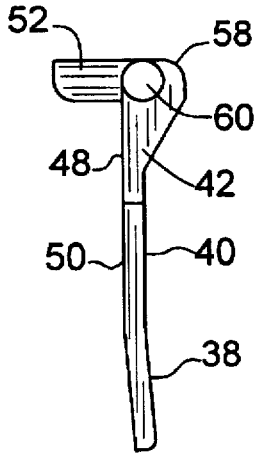
FIG. 11 is a side view showing the tongue lever member of the stirrup buckle of FIG. 10.
Figure 10:
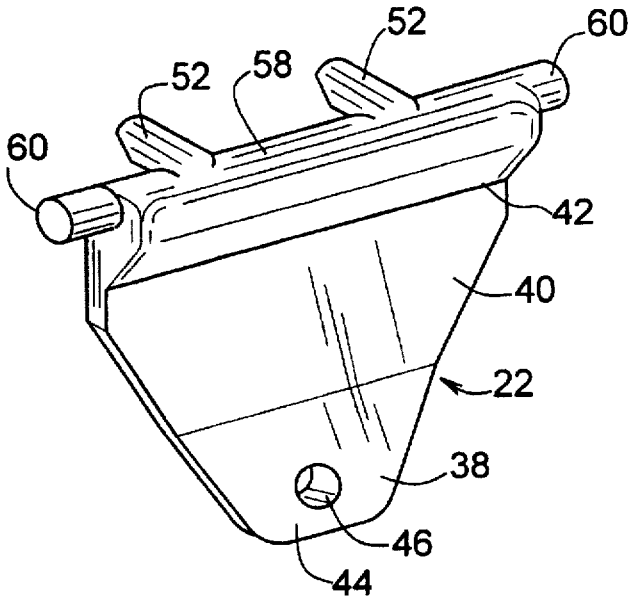
FIG. 10 is a perspective view showing the tongue lever member of the stirrup buckle of the present invention.

The stirrup buckle of the present invention is manufactured from readily available materials and simple in design. The preferred embodiment is comprised of a plastic material such as nylon; however, it is contemplated that other polymer composite materials, such as graphite fiber, acrylonitrile butediene styrene ("ABS"), or even fiberglass, could be molded and used in the present invention. Moreover, metal such as stainless steel, steel, or brass could be substituted for or used in combination with the plastic components of the present invention.

With reference to FIGS. 1–14, FIG. 1 shows the stirrup buckle 10 of the present invention in use with a saddle and horse, (shown in phantom lines), wherein the stirrup buckle 10 holds the stirrup 12 by the stirrup strap 14 securely to the saddle strap 16.

FIGS. 2–10 show the stirrup buckle 10 for releasably connecting a stirrup strap 14 to the saddle strap 16 of a saddle. The stirrup buckle 10 is a two piece assembly having a base mounting plate 18 with side flanges 20 and a pivoting tongue lever member 22 connected thereto pivotally mounted between the side flanges 20. The base mounting plate 18 securely attaches the stirrup buckle 10 to the stirrup strap More particularly the base mounting plate 18 of the preferred embodiment is of uniform thickness comprising a narrow front base portion 24 defining a neck, a wide rear base portion 26, and central base portion 28 connecting the narrow front base portion 24 to the wide base portion 26. At least one, and preferably a plurality of holes 30 are formed in the narrow front base portion 24. The narrow front base portion 24 is narrow for easy insertion in between a pair of stirrup straps 14 which are secured into position by holding means such as rivets or by sewing the straps 14 together. Of course it is contemplated that the base mounting plate 18 could be fabricated having a uniform width. In the preferred embodiment, the wide base portion 26 includes at least one and preferably a plurality of short slots 32 spaced apart and in alignment with one another at a selected distance wherein the elongated portion of the slots 32 is oriented in the front to back direction for cooperative engagement with the posts of the tongue lever member 22. The wide rear base portion 26 includes a pair of side flanges 20 extending upwardly therefrom having a generally trapezoidal shape. Each side flange 20 includes an aperture 34 for rotational cooperative engagement with the pegs of the tongue lever member 22. The apertures 34 are located near the side flange rear end 36 and in alignment with the slots 32 in the wide rear base portion 26.

The tongue lever member 22 is designed having an integrally formed thin generally trapezoidal shaped front tongue portion 38, a thin central tongue portion 40, and a thicker rear portion 42 including at least one, and preferably a pair of hinge posts 44 extending downwardly therefrom normal to the plane surface of the rear portion 42 for cooperative engagement with slots 32 formed in the side flanges 20 of the base mounting plate 18. The central portion of the tongue lever member 40 is flat. The front portion 38 of the tongue lever member 22 extends upwardly at a slight angle forming a tab 44 sometimes having a hole 46 therein for accommodating a string or pull member. The bottom surface 48 of the rear tongue portion 42 of the tongue lever member 22 extends outwardly in the same plane as the bottom surface 50 of the central tongue portion 40.

The tongue lever member 22 is pivotally connected to the base mounting plate 18 by a pair of pegs 60 each one extending from a side of the rear tongue portion 42 of the tongue lever member 22 and located near the rear of the rear tongue portion 42 for rotational cooperative engagement with apertures 34 formed in the corresponding side flanges 20 of the base mounting plate 18.

At least one post 52 and preferably, a pair of posts 52 are formed integrally with and on the underside of the tongue lever member 22. In the preferred embodiment the posts 52 extend normal to the surface; however, it is contemplated that the posts 52 may extend downwardly at a slight angle with respect to the tongue surface 48. The posts 52 are generally cylindrically shaped and have rounded ends. The posts 52 are spaced apart in a side by side relationship extending inwardly from the rear underside of the tongue lever member 22 for insertion through selected spaced holes 54 of the saddle strap 16. The posts 52 located on the tongue lever member 22 extend through matching slots 32 formed through the surface of the wide rear base 26 of the base mounting plate 18 flush with the exterior bottom surface 56 for securing the stirrup strap 14 and saddle strap 16 together.

The rear end edge 58 of the rear portion of the tongue lever member 22 is rounded and the rear surface of the posts 52 extend flush with the rounded rear edge end portion 58 for providing a camming surface for tightening the saddle strap 16 between the tongue lever member 22 and the mounting base plate 18 while simultaneously forcing the posts 52 through holes 54 formed in the saddle strap 16. The top surface 60 of the rear tongue portion 42 extends upwardly to the rear end edge 58 at an angle of from about 15 to about 60 degrees and preferably at an angle of about 30 degrees forming a thicker rear tongue rear portion 42 tapered from front to rear which forms a cam to hold the saddle strap 16 in position upon insertion between the tongue lever member 22 and mounting base plate 18.

Figure 14:
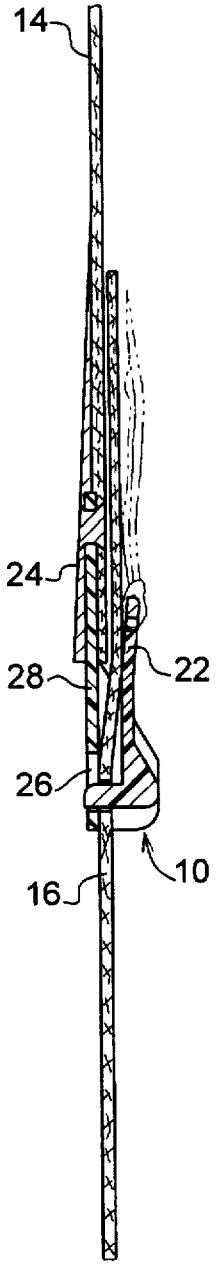
FIG. 14 is a sectional along lines 14—14 of FIG. 12 showing a saddle strap held in position between the base mounting plate and the tongue lever member, wherein the saddle strap overlaps a stirrup strap securing the base mounting plate.
Figure 13:
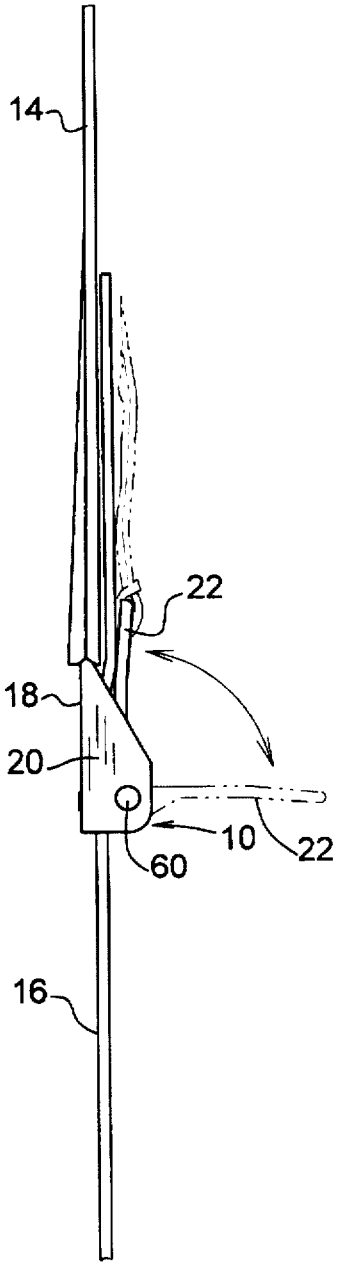
FIG. 13 is a side view of the stirrup buckle showing the front portion of the base mounting plate secured between two straps of the stirrup buckle, and a saddle strap protruding through the rear of the stirrup buckle in between the base mounting plate and the tongue lever member, and showing the tongue lever member in the closed horizontal position and also in the open position as shown in phantom lines.
Figure 12:
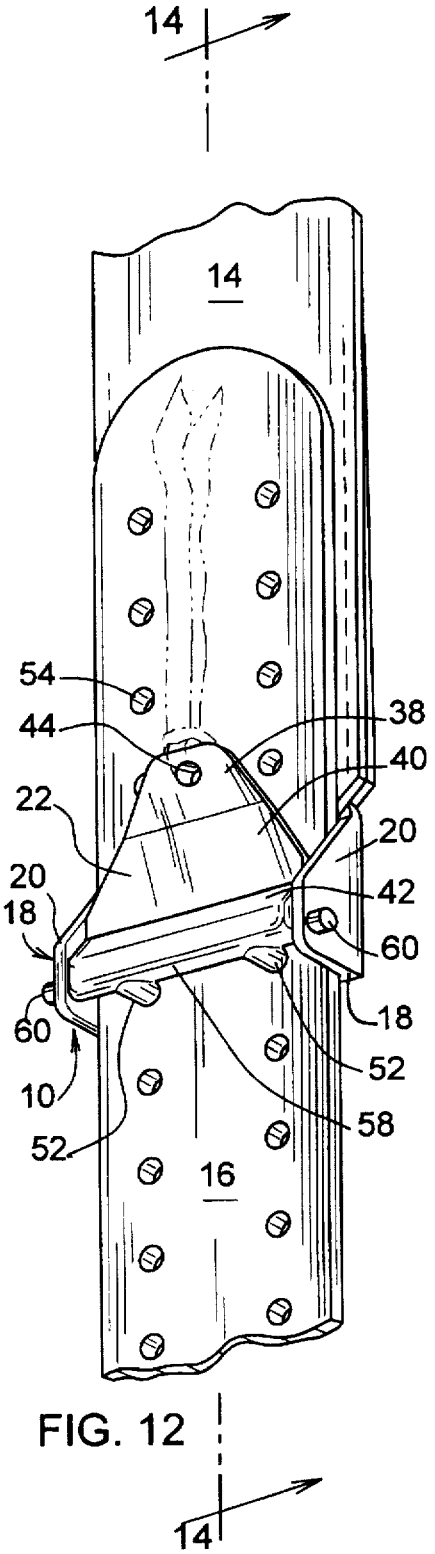
FIG. 12 is an enlarged perspective view of the present invention showing the stirrup buckle connecting a stirrup strap to a saddle strap.

The manner in which stirrup buckle 10 is utilized for connecting saddle strap 16 to stirrup strap 14 is illustrated in FIGS. 12–14. As best shown in FIG. 13, the tongue lever member 22 (shown in phantom lines) is raised to a perpendicular position to provide clearance between the bottom of the posts 52 and the top surface of the base mounting plate 18, wherein the free end of saddle strap 16 is inserted through opening to the desired position. The saddle strap 16 is pulled tight and the tongue lever member 22 is biased downwardly whereby the tongue rear edge 58 of the tongue lever member 22 holds the saddle strap 16 tightly against the stirrup strap 14 and inserts the posts 52 through the holes 54 of the saddle strap 16 and the slots 32 of the base mounting plate 18. As the stirrup strap 14 is pulled away from the saddle strap 16, the pulling force on the pegs 52 and the underside of the rear tongue portion 42 biases the central tongue portion 40 against the saddle strap 16 holding it tightly against the stirrup strap 14. The greater the longitudinal force pulling the straps 14 and 16 apart, the greater is the biasing forces holding the straps 14 and 16 together. Thus, not only do the pegs 52 provide a holding means, but the inner surface of the tongue lever member 22 also biases the straps together. Moreover, the stirrup buckle 10 of the present invention exerts pressure against the saddle strap 16 which lies against the stirrup strap 14 so that frictional force between the two straps provides additional holding forces.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

We claim:

1. A stirrup buckle for releasably connecting a stirrup strap with a saddle strap, said stirrup buckle comprising:

a base mounting plate having a pair slots therein and a flange on each side, each of said flanges having at least one hole therethrough;

a pivoting tongue lever member defining an angled front portion, a central flat portion, and a thick rear portion having a peg extending from each side cooperatively engaging said holes of said flanges of said base mounting plate, said pivoting tongue lever member including at least one post extending from the bottom of said rear portion for cooperative engagement with a saddle strap positioned thereinbetween and having holes therethrough and said slots of said base mounting plate.

2. The strirrup buckle of claim 1, wherein said base mounting plate and said pivoting tongue member conprises of material selected from the group consisting of brass, steel, aluminum, fiberglass, plastic, and conbinations thereof.

3. The stirrup buckle of claim 1, wherein said base mounting plate defines a narrow front portion, a wide wide rear portion, and a central tapered connecting portion thereinbetween.

4. The stirrup buckle of claim 1, wherein said flange is trapezoidal in shape for guiding the tongue of a strap thereinbetween.

5. The stirrup buckle of claim 1, wherein said pivoting tongue lever member includes at least two post extending from the bottom of said rear portion.

6. The stirrup buckle of claim 1, wherein said rear portion of said pivoting tongue member is rounded and a rear surface of said posts extending therefrom are flush with a rear edge end of said rear portion provifing a camming surface for tightening the saddle strap disposed between said tongue member and said mounting plate.

* * * * *